United States Patent [19]

Jalics

[11] 4,221,557

[45] Sep. 9, 1980

[54] APPARATUS FOR DETECTING THE OCCURRENCE OF INADEQUATE LEVELS OF COMBUSTION AIR AT A FLAME

[75] Inventor: Stephen M. Jalics, Rocky River, Ohio

[73] Assignee: Gas Research Institute, Chicago, Ill.

[21] Appl. No.: 914,978

[22] Filed: Jun. 12, 1978

[51] Int. Cl.[3] ..... F23N 5/24

[52] U.S. Cl. ..... 431/22; 431/52; 431/90

[58] Field of Search ..... 431/22, 42, 51, 52, 431/53, 59, 76, 89, 90, 77

[56] References Cited

U.S. PATENT DOCUMENTS

| | | | |
|---|---|---|---|
| 1,977,854 | 10/1934 | Knopp | 431/59 |
| 3,295,585 | 1/1967 | Kovach, Jr. et al. | 431/22 |
| 3,610,792 | 10/1971 | Risse | 431/22 |
| 3,683,670 | 8/1972 | Iriondo | 431/76 |
| 3,918,880 | 11/1975 | Risse | 431/22 |

*Primary Examiner*—Carroll B. Dority, Jr.
*Assistant Examiner*—Lee E. Barrett
*Attorney, Agent, or Firm*—Howson and Howson

[57] ABSTRACT

A sensor of inadequate combustion conditions at a main burner, comprising a small auxiliary gas burner the primary air-gas flow to which consists of a predetermined fraction of the flow of primary air and gas to the main burner plus a predetermined fraction of the flow of secondary air supplied to the main burner, with no secondary air supply of its own. The total combustion air thus supplied to the auxiliary burner is made such that the flame at the auxiliary burner extinguishes when the combustion air at the main burner flame becomes inadequate for satisfactory combustion but is still sufficient to maintain a flame at the main burner. A flame sensor at the auxiliary burner produces indications of absence of flame at the auxiliary burner, which in turn indicates inadequate combustion conditions at the main burner.

4 Claims, 9 Drawing Figures

APPARATUS FOR DETECTING THE OCCURRENCE OF INADEQUATE LEVELS OF COMBUSTION AIR AT A FLAME

BACKGROUND OF THE INVENTION

There are many applications in which it is desirable to provide an indication of when the combustion air present at a flame is inadequate for satisfactory combustion, but still sufficient to maintain the flame. Typically, some of the combustion air for the flame is supplied as part of a primary air-gas mixture, and the remainder is supplied as secondary air. If the amount of combustion air supplied to the flame is gradually reduced below a predetermined minimum level adequate to produce satisfactory combustion, the flame will at first continue to persist, but combustion will be incomplete, and it is only after the supply of combustion air has been reduced substantially farther that the flame will actually be extinguished. Consequently, if one merely uses a simple conventional flame sensor to turn off the gas supply when the flame extinguishes, this will not prevent the flame from continuing to burn when the combustion air level is below the minimum adequate level for satisfactory combustion but above the flame-extinction level. Permitting combustion to continue with inadequate levels of combustion air not only wastes fuel, but is also pollutive of the atmosphere and/or may produce undue quantities of potentially harmful combustion gases such as carbon monoxide.

One application of the invention, with reference to which it will be particularly described, is in connection with the main gas burner for a domestic hot-air furnace using a heat exchanger, in which a primary air-gas mixture is supplied under pressure to the interior of the main burner body and exits at the main burner ports, the flame at the burner ports also being supplied with secondary air which typically flows first along the bottom of the main burner, then upward along the sides of the burner to the flame area; the combustion products heat the interior of the heat exchanger, and are then vented through an appropriate flue, which flue is an extension of the passage provided for the flow of secondary air. Such flow of secondary air and combustion products is typically by natural thermal convection.

It has been found that if there is a perforation in the wall of the heat exchanger which separates the combustion products from the chamber through which the room air to be heated is circulated, or if there is a substantial blockage in the flue, the normal flow of secondary air to the vicinity of the flame may be substantially reduced to below the minimum adequate level for satisfactory combustion, even though the flame persists, with the above-mentioned drawbacks of fuel inefficiency, environmental pollution and possible danger. Since the flame does not become extinguished under these assumed circumstances, it is not possible to detect the undesired reduction in secondary air by merely detecting absence of the flame.

Devices are known in the prior art which can, to some extent at least, detect the quality and extent of combustion in a flame, for example certain types of heat and radiation sensors which have been used on large industrial furnaces. However, such devices are typically quite complex and costly, and in fact may in some instances be more costly than an entire domestic hot air furnace.

Also known are combustion-sensitive pilot-flame devices, in which a pilot flame is located near a main burner so that, upon the occurrence of insufficient combustion air at the main burner, the recirculation zone for combustion products which is normally located well above the burner will descend to the region occupied by the pilot flame and cause it to extinguish; a flame sensor indicating such extinction then acts to turn off the gas supply to the main burner and to the pilot burner. However, in certain straightforward applications to furnace heat exchangers, the scheme was found not to be as effective and reliable as desired.

Recent increases in the frequency of occurrence of perforations in furnace heat exchangers have been attributed to an increasing home use of products using spray-can propellants, as well as to leakage of compounds similar to spray spray propellants from compressor-type air conditioners and refrigerator freezers in the home, such materials typically comprising hallogenated hydrocarbons which tend to produce premature corroding of the metal of furnace heat exchangers.

It is therefore an object of the invention to provide new and useful apparatus for detecting inadequate levels of combustion air at a flame.

It is also an object to provide such apparatus which is reliable yet inexpensive.

SUMMARY OF THE INVENTION

In accordance with the invention, there is provided an auxiliary gas burner, the flame of which extinguishes when the combustion air at a main burner is less than that necessary for satisfactory combustion but sufficient to permit the main burner flame to persist. The auxiliary gas burner comprises mixing means supplied with a predetermined fraction of the flow of air-gas mixture to the main burner and with a predetermined fraction of the secondary air flow to the main burner; these components are mixed in the mixing means, which may be a simple chamber, and supplied to the auxiliary burner port. The fractions supplied to the mixing means are so adjusted that the auxiliary burner flame extinguishes when the combustion air at the main burner is inadequate for proper combustion. Means are provided for sensing the absence of the auxiliary flame, to provide indications of inadequate mainburner combustion, preferably in the form of a signal which turns off the gas supply for both main and auxiliary burners.

The secondary-air fraction for the auxiliary burner is preferably provided by means, such as an air scoop, extending into the path of flow of secondary air to the main burner, for deflecting a portion of said flow into the mixing chamber of the auxiliary burner. The air-gas fraction supplied to the mixing chamber is preferably derived by providing aperture means in at least one wall of the mixing chamber which communicates with the interior of the body of the main gas burner. Additional wall means extending above the auxiliary burner port are preferably also provided with aperture means communicating with the interior of the body of the main gas burner, to provide additional air-gas mixture to the auxiliary burner port above the burner port for stabilizing the flame. The auxiliary burner port is peferably positioned horizontally between main burner ports, and is preferably surrounded by a wall extending higher than the auxiliary burner port, to shield the auxiliary burner port from external secondary air, while permitting it to be reignited by the main burner flame and while permitting incomplete combustion at the auxiliary burner flame to be completed by the main burner flame.

BRIEF DESCRIPTION OF FIGURES

These and other objects and features of the invention will be more readily understood from a consideration of the following detailed description taken in connection with the accompanying drawings, in which.

DETAILED DESCRIPTION OF PREFERRED EMBODIMENTS

Figure 1:
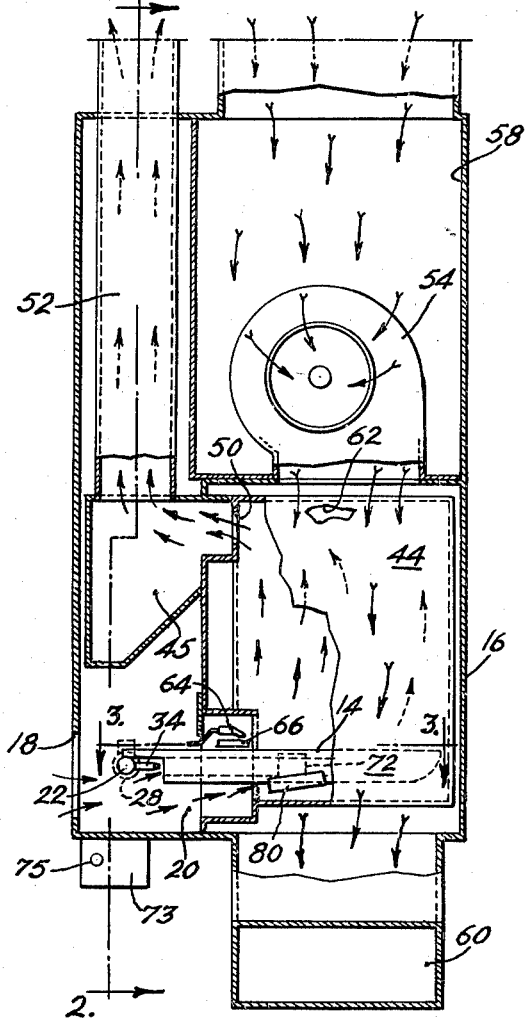
FIG. 1 is a vertical section of a domestic hot-air heating furnace system in combination with the sensor of the invention, as viewed from one side.
Figure 2:
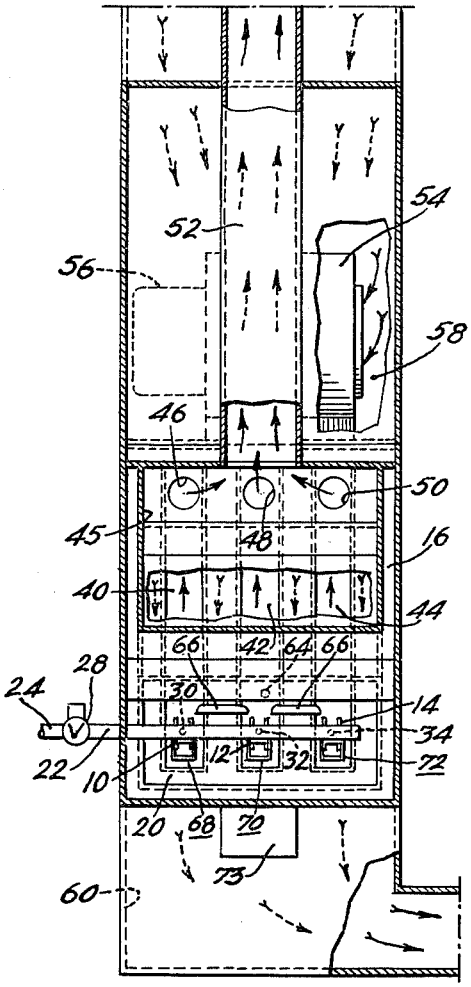
FIG. 2 is a vertical section of the furnace system of FIG. 1, taken along lines 2—2 of FIG. 1.

Referring now particularly to the specific embodiment of the invention shown in the drawings, and especially first to the general overall organization as shown in FIG. 1 and 2, the domestic hot-air furnace shown comprises three side-by-side main burners 10, 12 and 14 supported conventionally by means (not shown) in the interior of a casing or jacket 16. Secondary air for the main burners is drawn in by natural convection through a secondary air inlet 18 near the bottom of the unit, and then through secondary air passage 20 leading from the inlet to the main burners. Primary air-gas mixture for the main burners 10, 12 and 14 is provided by supplying gas to pipe 22 from fuel-gas supply pipe 24 by way of electrically controllable gas valve 28, and mixing this gas with primary air by means of conventional air-mixing nozzle arrangements 30, 32 and 34 respectively.

The main burners 10, 12 and 14 are located at the bottoms of respective heat exchangers 40, 42 and 44. Each heat exchanger comprises a chamber relatively narrow in one horizontal dimension and deep in the other horizontal dimension, extending upwardly from its corresponding main burner so to be internally heated by the combustion products thereof. Conventionally the major sidewalls of the heat exchanger are provided with appropriate ribs and dimples to enhance the scrubbing action and heat transfer, to provide additional rigidity, and to minimize undesired wall vibrations. The upper ends of the three heat exchangers are provided with respective flue outlets 46, 48 and 50 for exhaust of the hot combustion gases to an appropriate common collector chamber 45 and thence to a common flue or stack means 52.

The jacket 16 extends around, and is outwardly spaced from, the heat exchangers, and the house or room air to be heated is passed through the space between jacket 16 and the heat exchangers. This is accomplished by means of an air blower 54 and blower motor 56 which draws house air from an air return duct 58, forces it through the interior of the jacket and over the hot exterior surfaces of the heat exchangers, and delivers it to the room-air outlet duct 60, for re-circulation through the interior region of the house to be warmed by the furnace. Also shown is an undesired hole or perforation 62 extending through the upper sidewall of heat exchanger 44. Such holes typically and desirably do not exist, but, under some conditions of long-term corrosion, may occur, and one such is shown for purposes of explaining the present invention. Because the house air within the jacket 16 is under pressure due to the action of the blower 54, there will be a tendency for such room air to be forced inwardly through the undesired hole 62, into the interior of the heat exchanger. Such inward flow will typically interfere with, and reduce, the flow of secondary air to the main burner, particularly in the present example where such secondary air flow is entirely by natural convection. When this occurs, the total combustion air at the main burner will be reduced, and when sufficiently reduced will ultimately result in less than adequate combustion at the main burners, with the adverse effects mentioned hereinbefore. These include necessary atmospheric pollution due to incomplete combustion products reaching the atmosphere, inefficient burning resulting in fuel waste, and production of noxious or harmful gases which may not only tend to pollute the external environment but may to some extent leak into the house itself, constituting a potential although rare source of danger.

Typically there is also provided a standing pilot burner 64 for reigniting the main gas burners by way of pilot flash tubes 66 when there is a demand for heat; the details of this arrangement being conventional and unrelated to the present invention, they have not been shown in detail.

To provide for shut-off of the supply gas to the main burner upon the occurrence of seriously incomplete combustion, in accordance with the invention there are provided in this example three auxiliary gas burners 68, 70 and 72, one such auxiliary burner for each of the main burners. The general position of the auxiliary burners is shown in FIGS. 1 and 2 to a small scale, while various detailed aspects thereof are shown more fully in FIGS. 3-8, in which corresponding parts are indicated by corresponding numerals. Only one such auxiliary burner and its connections will be shown and described in detail, since auxiliary additional burners in the other main burners may be substantially identical. An electrical control box 73 with a reset pushbutton 75 is also provided on the front part of the furnace to house the control circuitry described hereinafter.

Referring particularly to FIGS 3-8, auxiliary burner 72 comprises mixing means in the form of a mixing chamber 74, the bottom of which is provided with an opening 76 communicating with the secondary supply air passage 20 by way of a corresponding opening in the main gas burner body 78. More particularly, in this example the mixing chamber 74 sits directly on the bottom of the main gas burner body 78, with the bottom of the mixing chamber completely open and aligned with a corresponding coincident opening in the bottom of the main burner body. A scoop 80 extends below opening 76 is closed on all sides except at the end 81 thereof, facing the secondary air inlet 20, which extends downward across a portion of secondary air passage 20. The scoop 80 therefore serves to divert a portion of the secondary air flow for the main burner, into the mixing chamber 74 of the auxiliary burner. In this example, the scoop comprises a fixed closed end 80A, and a U-shaped channel member 80B pivotable for adjustment about hinge axis 80C.

Mixing chamber 74 is also supplied with primary air-gas mixture by way of aperture means in the form of two horizontal rows of holes such as 82, 84 in the opposite sidewalls thereof, these holes communicating directly with the main burner body 78 so that the primary air-gas mixture in the main burner body can flow or leak into the mixing chamber 74 in response to the pressure of the latter primary air-gas mixture.

From the mixing chamber, the external walls of the auxiliary burner extend upwardly at 86, still within the main gas burner body, to surround the auxiliary burner port means 88. The latter port means comprises, in this example, a plurality of plates or ribbons such as 90 horizontally spaced apart from each other, with their major surfaces confronting each other. The mixture of mainburner secondary air and mainburner primary air-gas mixture from the mixing chamber 74 rises through the openings between the ribbons 90 and, under proper conditions of furnace operation, is burned in a flame positioned at and immediately above the auxiliary burner port.

In order to stabilize and make reliable the flame operation of the auxiliary burner, there are preferably provided additional aperture means, in this example in the form of the two horizontal rows of holes such as 92, 94 in opposite sidewalls near the top of the auxiliary burner, which holes are at a higher level than the auxiliary burner port but still at a level as to communicate directly with the interior of the main burner body. Accordingly, additional primary air-gas mixture from the main burner body flows or leaks into the region just above and adjacent the top of the auxiliary burner port, to provide an additional stabilizing action for the flame.

The top of the main burner body is open immediately above the auxiliary burner port to permit the auxiliary burner wall at 96 to extend upwardly through it and to provide an open top section wherein the flame occurs, and to permit combustion products to flow upwardly into the region adjacent the main burner flames for completion of their combustion. Wall means 96 surround the top opening of the auxiliary burner, to shield further the flame region of the auxiliary burner from any externally-supplied secondary air, so that the auxiliary burner flame is dependent entirely upon the mixture from the mixing chamber for its total combustion air.

Concerning now the normal general operation of the system, when the room thermostat indicates a demand for heat in the home, it automatically turns on gas valve 28 to supply gas to the main burners and auxiliary burners. The pilot flame ignites the main burners, which in turn ignite the auxiliary burners in the absence of perforations in the secondary heat exchanger or some blockage in the furnace vent system which might similarly reduce secondary air flow. The main burner flames will then operate to heat the heat exchangers and thus heat the house air which is forced over their exterior sidewalls by the blower, as desired, until such time as the extent of heating causes the thermostat again to turn off the gas valve, the cycle being repeated as required.

However, should the combustion air available at the main burners become less than that required for adequate combustion, due for example to the occurrence of a hole in a heat exchanger, blocking of the venting system, or for any other reason, the aeration of the main burner flame might tend to decrease toward a point at which it becomes pollutant, energy wasting and/or even dangerous, except for the intervening action of the auxiliary flame sensor apparatus of the invention.

The auxiliary gas burner 72, under normal, desirable conditions for main burner combustion is supplied with a portion of the secondary air flow for the main burner by way of the deflecting action of scoop 80, causing a fraction of such secondary air to flow into the mixing chamber 74 thereof. At the same time, the pressure of the primary air-gas mixture in the main gas burner body 78 causes a predetermined fraction of the primary air-gas mixture for the main burner to flow into the same mixing chamber. The resultant mixture is supplied as primary air to the underside of the auxiliary burner port 88, where it is sufficient to maintain a flame at the upper surface of the latter auxiliary burner port, although this flame may not itself exhibit complete combustion. The effects of such incomplete combustion at the auxiliary burner port are substantially eliminated because of the fact that the combustion products thereof flow into the region occupied by the main burner flames, and all are substantially completely combusted in the area above the main burner flames.

The air-gas mixture supplied from the mixing chamber to the auxiliary burner is selected, as by adjusting of the scoop inlet cross-section, to contain a proportion of combustion air which is a substantially smaller percentage of the stoichiometric amount than is the case for the main burner; for example, the normal total aeration for the main burner may be about 135% and for the auxiliary burner about 80%. As a result, when for any reason there is an excessive decrease in the quantity of secondary air supplied to the main burner (for example, below about 105% aeration), the combustion air supplied to the auxiliary burner will be correspondingly reduced below the flammability limit (about 65% aeration) while the main burner remains well above the flammability limit. Accordingly, upon the occurrence of the above-described excessive reduction in flow of secondary air to the main burner to a point at which combustion thereat is less than adequate, the combustion air for the auxiliary burner, which comes from the same source as the secondary air for the main burner and is proportional thereto, will decrease to a point at which the mixture at the auxiliary burner port becomes too rich for combustion to continue, and the auxiliary burner flame extinguishes.

Such extinction is sensed by a conventional flame sensor 98, which may be an ionization flame probe, although other types of suitable devices may be utilized. The flame sensor 98 is insulatedly mounted to the metal wall of the mixing chamber by a ceramic insulating cylinder 98A extending through a mounting block 99, and further supported by a ceramic post 98B; it serves to produce an electrical signal which indicates the presence or absence of the auxiliary burner flame. This signal is supplied to control box 73 containing suitable electrical elements for turning off controllable gas valve 28 when the auxiliary gas flame undesirably disappears when it should be present, while allowing the latter controllable gas valve to remain on at other times during heat demand.

Accordingly, the system will be shut down by closing of the gas valve whenever the auxiliary burner flame extinguishes while the main burners are operating, but with inadequate combustion. Such a shut-down will be an indication that the furnace should be inspected for heat exchanger holes or vent blockage, for example, and after suitable repairs the system can be re-started, which can be accomplished by manually the reset pushbutton 75, until the entire system begins functioning.

The control apparatus which responds to the absence of auxiliary burner flame to shut off the gas supply may take a variety of different forms, and the following is presented merely as one example thereof.

Figure 9:
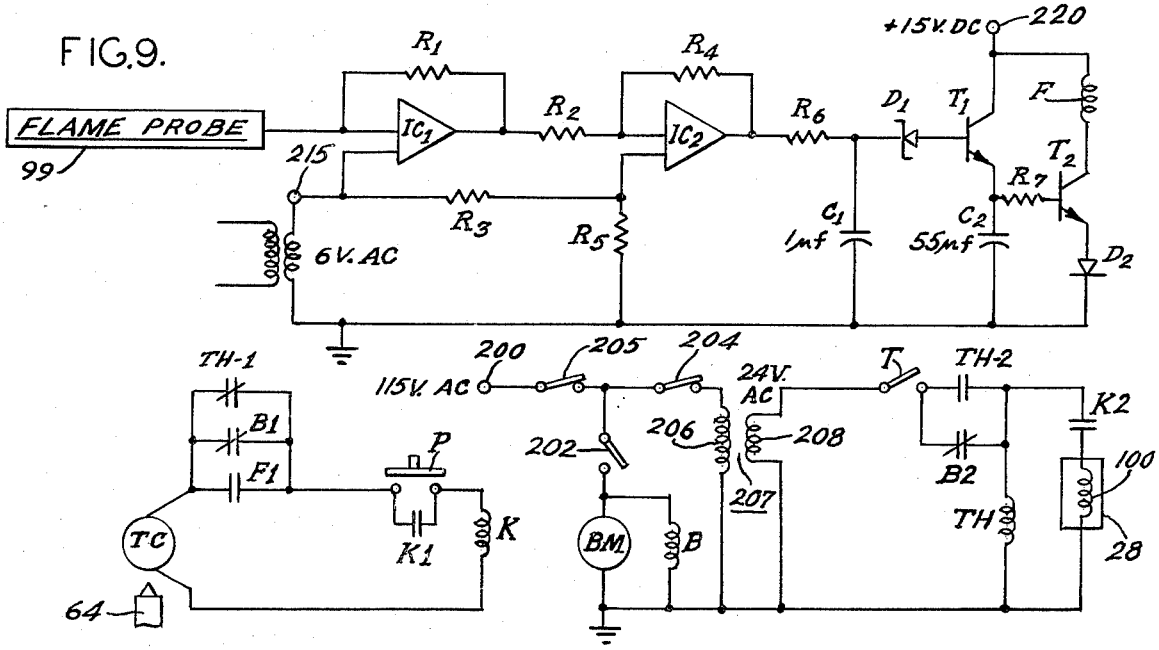
FIG. 9 is a schematic diagram of an electrical control unit suitable for use with the sensor.
Figures 3, 4, 5, 6, 7:
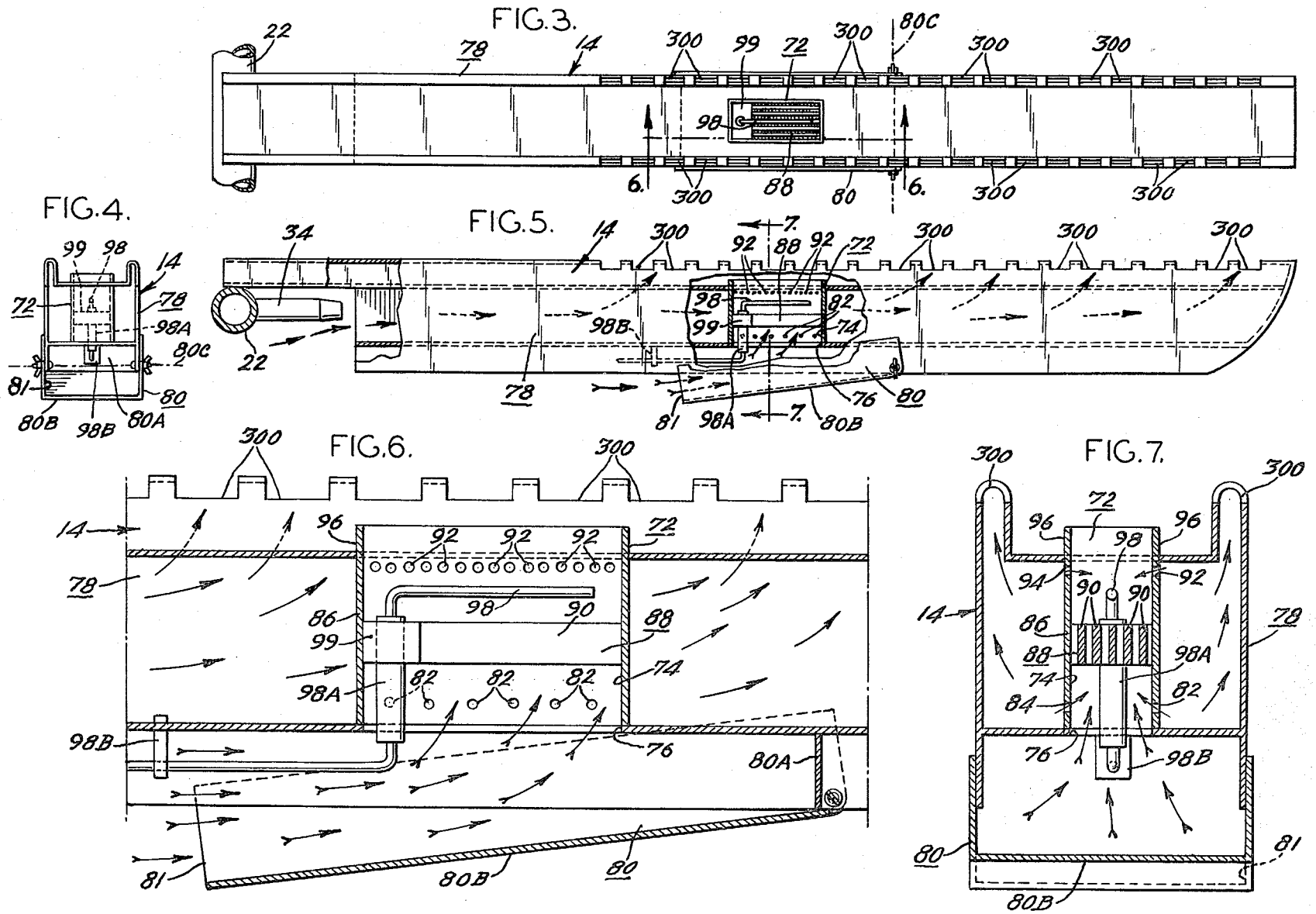
FIG. 3 is an enlarged top view of one of the main burners and sensors of FIG. 1.
FIG. 4 is an end view of the main burner and sensor of FIG. 3.
FIG. 5 is a side view of the main burner and sensor of FIG. 3, with parts broken away.
FIG. 6 is an enlarged fragmentary sectional view of a portion of the main burner and sensor of FIG. 3, taken along lines 6—6 of FIG. 3.
FIG. 7 is an enlarged sectional view taken along lines 7-7 of FIG. 5.
Figure 8:
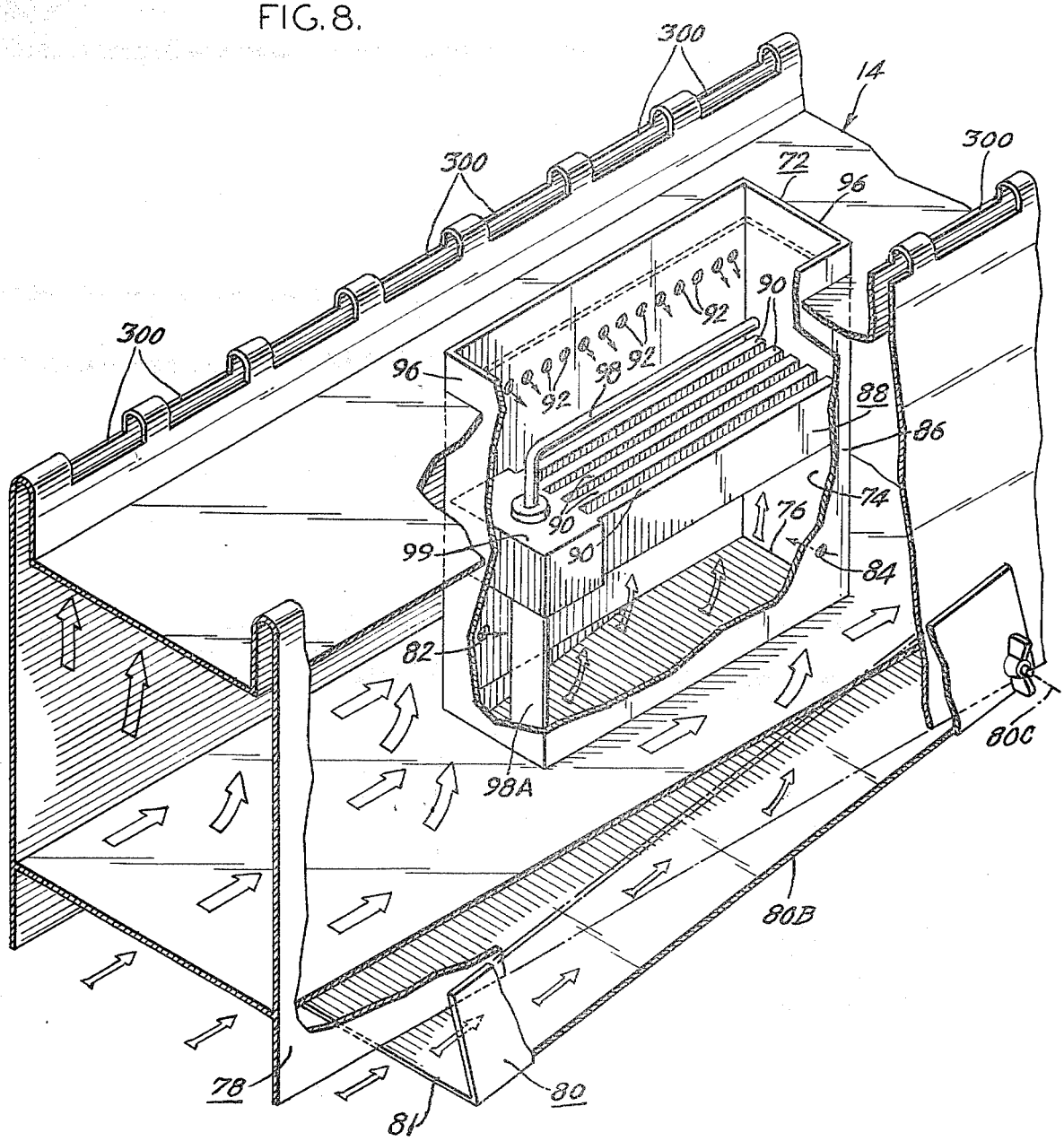
FIG. 8 is a perspective view of the sensor and an adjacent portion of the main burner.

Referring now to FIG. 9, the electrical control circuit shown therein may be mounted in control box 73, accessible from the front of the furnace. There are a number of general functions which the circuit provides, as follows. When combustion conditions at the main burner flame are normal and adequate, closing of the room thermostat T, indicating a demand for heat, will turn on the gas valve 28 to supply gas to the main burner and auxiliary burner. During the initial furnace warm-up period, the blower motor remains off, and during this time the sensor flame stabilizes itself on the auxiliary burner ports; when the blower motor comes on, operation continues in the normal way. At the same time, the normal standing pilot burner is continuously operating, so as to permit the above-described turning on of the gas valve. When the heat demand is satisfied, the room thermostat opens, the gas valve is deactuated, and the gas to the main burner and the auxiliary burner is cut off. The blower motor normally continues to operate until the temperature of the circulating air just outside the heat exchangers is appropriately reduced, and then is shut off. This normal cycle repeats in accordance with the room heat demand, under normal conditions. At the same time, if the pilot burner should become extinguished, the circuit operates to close the gas valve and lock it closed until the pilot is reignited and the manual reset effected. These functions in themselves are provided by normal standing-pilot furnace control circuitry.

However, if there is inadequate combustion air at the main burner due for example to flue blockage or a perforation in heat exchanger, the auxiliary flame extinguishes, a fact which is sensed by the auxiliary flame sensor and used to shut off the gas valve. Since it is possible there may be some momentary instability or extinction of the auxiliary burner flame, not indicative of flue blockage or heat-exchanger perforation, the circuit includes an appropriate delay which causes gas valve shut-down to occur only if the auxiliary sensor flame is absent for a substantial interval of time. The shut-off of the gas valve in response to absence of the auxiliary burner flame operates through the pilot burner circuit to effect lock-out of the gas valve, requiring manual re-setting of the gas valve circuit to turn it on again. Other preferred functions, and a specific circuit for accomplishing them, will now be described in detail with reference to FIG. 9.

In this circuit, the coil for each relay is indicated by an appropriate letter, and the contacts actuated thereby are indicated by the same letter followed by an appropriate number. The illustrated condition of the relay contacts is for the completely deactivated state of the entire circuit.

Considering first the pilot burner control circuit, the pilot burner 64, when on, heats a thermocouple TC to produce a current through relay coil K provided that the series circuit therethrough is closed by appropriate closing of the several sets of contacts therein. More particularly, if any of contacts F1, B1 or TH-1 is closed, then momentary actuation of pushbutton P will cause a current to flow in valve K, actuating contacts K1 to their closed state so that upon release of the momentary-contact switch the circuit will remain in its "locked up" condition with current continuing through relay coil K. This condition will continue until the latter current is interrupted, at which time current remains off until a subsequent actuation of pushbutton switch P with at least one of contacts F, B or TH-1 closed.

Current through relay coil K closes contacts K2 to enable the supply of current of the solenoid coil 100 of gas valve 28, which latter current, if present, will close the gas valve. Also in series with relay coil K is the parallel combination of normally-open contacts F1, actuated to a closed position by current through coil F; normally-closed contacts B1, opened by current through blower relay coil B; and normally-closed relay contacts Th-1, opened in response to current through thermostat coil TH. Accordingly, only upon the opening of all of the three latter parallel-connected sets of contacts (or failure of the pilot flame) will current be terminated in relay coil K, to open contacts K2 and shut off the gas supply.

Normal alternating line voltage, such as 115 volts AC, is applied to supply terminal 200. When thermally-controlled switch 202 is closed by the occurrence of a sufficiently high air temperature outside the heat exchangers, the line supply voltage will be applied across blower motor BM to cause it to run, and current will be produced in the parallel-connected relay coil B. A conventional bimetal thermal limit switch, which remains closed unless the temperature of the air just outside the heat exchangers becomes abnormally high, delivers the AC supply voltage also to the primary 206 of step-down transformer 207, to produce at its secondary 208 a reduced alternating voltage, such as 24 volts. When the room thermostat T is not demanding heat, switch T is open, no current can be supplied to the solenoid coil of gas valve 28, and the gas remains turned off.

When room thermostat switch T is initially closed by heat demand, current initially flows through relay contacts B2 and relay coil TH to the ground, which immediately closes contacts TH-2 and holds them closed until thermostat T reopens at the end of heat demand. Alternating voltage is thereby applied to the series combination of contacts K2 and the solenoid of gas valve 28 and, contacts K2 being closed at the initial time, the gas valve is turned on automatically.

Current in coil TH also opens contacts TH-1, but coil K remains actuated by current through contacts B1, until the blower motor comes on and coil B is supplied with current; coil B then opens contacts B2 and B1, so that if by this time contacts F1 have not been closed by current through relay coil F, current through coil K will terminate, contact K2 will open, and the gas valve 28 will be shut off and remain so until the system is re-started by operation of manual pushbutton P with at least one of TH-1, B1 or F1 closed. Since, as will be described in detail, current through coil F disappears only after the auxiliary burner flame has disappeared for a predetermined interval, such shut-down and lock-out of the gas valve will occur only upon the occurrence of improper combustion conditions at the auxiliary burner and main burner, due for example to flue blockage or perforation of the heat exchanger.

Assuming now that combustion is adequate and current is flowing in coil F, the main and auxiliary burners will continue to operate until the heat demand is satisfied, at which time room thermostat switch T will automatically open. This will immediately remove supply current from the gas valve solenoid and cut off the gas supply valve 28. Contacts TH2 then immediately reopen, and contacts B2 remain open until the blower stops operating, so that if T should reclose when the blower is still operating from the previous cycle, the gas supply will not be then turned on.

Considering now the portion of the circuit of FIG. 9 which operates relay coil F in response to flame probe 99, it will be understood that a different such circuit is used for each of the three flame probes, each connected to a relay coil such as F positioned to control a corresponding set of relay contacts such as F1; that is, F1 will consist of three pairs of contacts in series, each controlled by a different coil F. For clarity, only one set of contacts F1 is shown. In this example, the flame probe 99 is connected to a first input terminal of operational amplifier $IC_1$, a second input terminal of which receives alternating current, for example 6 volts AC from terminal 215. A back-coupling resistor $R_1$ connects the output terminal of $IC_1$ to its first input terminal.

Flame probe 99 is positioned in the area in which the auxiliary flame is located, so that when the flame is present an alternating voltage is applied between the probe and the grounded metal of the auxiliary burner, and a current will flow between probe and ground, through the flame area; when no flame is present, no current will flow. The flame possesses an asymmetrical conduction characteristic, such that the current passing through it is at least partially rectified, i.e. a sinusoidal voltage applied to it will produce a non-sinusoidal current having an average DC level different from that which would result if the flame exhibited a simple symmetrical resistance. With no flame present, feedback current through resistor $R_1$ cannot flow through the probe, and the output of $IC_1$ is a symmetrical sinewave reproducing the input sinewave from terminal 215. However, if the flame is present, the asymmetrical current path through the probe and flame causes the output of $IC_1$ to be asymmetrical i.e. in this example to have a substantial positive DC component compared with the no-flame situation.

The output of $IC_1$ is supplied through series resistor $R_2$ to the first input terminal $IC_2$, and the AC supply voltage from terminal 215 is supplied to the second input terminal of $IC_1$ by way of series resistor $R_3$. $IC_2$ is also provided with a feedback resistor $R_4$, and with a resistor $R_5$ between the second input terminal and ground, whereby its output is an amplified version of the sinusoidal current through the flame probe.

The latter output is applied to an integrator consisting of series resistor $R_6$ and shunt capacitor $C_1$, which acts to produce across capacitor $C_1$ a DC voltage proportional to the DC component of the output of $IC_1$; typical values for $R_6$ and $C_1$ are 33,000 ohms and 1 microfarad, respectively. Accordingly, the voltage across capacitor $C_1$ will be essentially zero when the flame is absent, or if an accidental partial or complete short-circuit should cause an anomolous AC voltage to be produced in the circuit preceeding the integrator. However, when flame is present, a positive DC voltage is rapidly developed across $C_1$.

The voltage across capacitor $C_1$ is applied through zener diode $D_1$ to the base of a transistor $T_1$. $D_1$ is poled so that it breaks down and becomes conductive as soon as the voltage on $C_1$ exceeds a predetermined rather low threshold level. This turns on otherwise non-conductive NPN transistor $T_1$, to pass current from its collector to its emitter in response to DC supply voltage at terminal 220, which in turn rapidly charges $C_2$ positively.

The voltage on $C_2$ is supplied through series resistor $R_7$ to the base of transistor $T_2$, the collector of which is connected through relay coil F to DC supply terminal 220 and the emitter of which is grounded through diode $D_2$; $D_2$ is so poled that such conduction will start only when the emitter voltage of $T_2$ has risen to a preselected threshold level.

In operation then, in the presence of flame, $T_2$ is turned on, current passes through relay coil F and contacts F are held closed; if the flame disappears, current continues in coil F and contacts $F_1$ remain closed for several seconds, so that chance momentary absence of the flame will not open contacts F1 and shut off the gas. This time delay is provided by the discharge time constant of $C_2$ through resistor $R_7$, which typically may be about 5 seconds. If the flame is absent for more than such time, $T_2$ turns off, current in coil F terminates, and contacts F1 open to cause shut-down and lockout of the gas valve 28.

The detailed interaction of coil F with the remainder of the circuit is as follows. As described previously, under normal conditions with no heat-exchanger perforations and no flue blockage, the auxiliary burner flame is present, and contact F1 will be held closed by coil F. The operation of the remainder of the circuit at such times is as described previously. However, with thermostat T closed to demand heat and contacts TH-1 therefore open, should the auxiliary burner flame become extinguished for more than a short period of a few seconds, the current in coil F will disappear and contacts F1 will open. If this occurs before the blower comes on, the gas valve is not shut off because contacts B1 are then closed; this does no harm, since it is not until the blower begins to operate that a heat exchanger perforation will produce poor combustion. However, once the blower does begin to operate, B1 is also opened, and if F1 is still open the coil K will be deactuated and locked out, and gas valve 28 turned off until later manual reset. Such shut-down and lock-out of the gas valve will therefore occur only if, when thermostat T is closed in response to heat demand and blower motor BM is operating, the auxiliary flame sensor circuit detects no flame for more than a few seconds and therefore opens contacts F1. When this does occur, the complete system may be turned off by power switch 205, repairs made to remove the flue blockage or heat exchanger perforation, and with the power back on, the system is reset to normal operation by manual actuation of switch P.

The foregoing is merely one of many possible control circuits which may be utilized in the combination with the auxiliary burner sensor of the invention, some of which have specific advantages or disadvantages in particular applications thereof.

For any given application, the proportion of air supplied to the mixing chamber can be selected to cause extinction of the auxiliary burner flame at any desired reduction below normal of the combustion air available to the main burner. For natural gas, the auxiliary burner flame typically extinguishes when the percentage total aeration falls below about 65% of the stoichiometric proportion. By selection of the size and configuration of the air scoop 80, and/or by selection of the size and number of holes 82 which admit primary air-gas mixture of the mixing chamber, the level to which the aeration of the main burner flame will drop before the auxiliary burner extinguishes can be adjusted.

In this connection, it is noted that the size of the holes such as 82 through which the primary air-gas mix from the main burner body flows into the mixing chamber should also be carefully selected from another viewpoint. Usually the primary air-gas mixture for the main burner stays constant, and it is the secondary air flow which decreases, and it is this decrease which the auxiliary burner is to sense. Therefore, the holes usually should be made small so that the relatively high pressure in the burner body will not cause a primary air-gas flow into the mixing chamber to counteract or change the desired, rather gentle, flow of secondary air into the mixing chamber, or even actually cause a flow out of the scoop, preventing influx of secondary air. It is also advantageous to achieve a thorough mixing in the mixing chamber, in order to obtain the most stable auxiliary burner flame and extinction point.

The auxiliary burner ports should also be designed so that the auxiliary flame does not flash back through the ports, and they are preferably located near the main burner flame so as to be lit by the main burner flame. The upper rows of holes such as 92 for supplying extra primary mix from the main burner body to the upper part of the auxiliary burner above the ports has been found to minimize alternate flame lift-offs and reignitions, and to further stabilize the transition point from flame to no-flame conditions.

In one typical example of physical parameters which has been used successfully, the fuel gas was natural gas; the outside dimensions of the auxiliary flame sensor unit were about $1\frac{3}{8}$ inch in height, $1\frac{1}{2}$ inches in length and $\frac{3}{8}$ inch in width; the lower holes comprised two rows 82, 84 of 6 holes each (total of 12 holes) evenly spaced from each other, each hole being about 0.033 inch in diameter, the center-line of the holes being about $\frac{1}{8}$ inch above the bottom of the mixing chamber; the upper holes comprised two rows 92, 94 of 15 holes each (total of 30) evenly spaced from each other, each hole being about 0.040 inch in diameter, the center-line of the holes being about 7/16 inch above the the tops of the burner port ribbons or plates 90; the burner port ribbons were 5 in number, each about 3/16 inch high, about 0.0375 inch thick and spaced about 0.031" apart from each other, the bottoms of the ribbons being about $\frac{3}{8}$ inch above the bottom of the mixing chamber; the sidewalls of the sensor unit extended about 3/16 inch above the top of the main burner body; the operative portion of the ionization flame probe was about 0.040 inch in diameter, encased in a cylindrical ceramic insulator about 0.2 inch in diameter; the entire auxiliary burner unit was laterally centered with respect to the main burner ports such as 300; the main burner unit was about 22 inches in length, with the auxiliary burner unit located about 9178 inches from the front end thereof; the entire furnace was about 30 inches high and about 19 inches deep, and operated at an input rate of about 80,000 Btu/hour; the air-gas mixture in the main burner body had a pressure of about 0.2 inch water column, and a primary aeration of about 40–50% of the stoichiometric amount; the auxiliary flame extinguished, the gas supply was thereby automatically shut off, when the estimated total aeration of the main burner flame fell below about 115%. In this example, the scoop opening 81 was about 1inch in height and about $1\frac{1}{4}$ inches wide.

While the drawings show one specific way of supplying a portion of the main-burner primary air-gas mixture and a portion of the main-burner secondary air to the mixing chamber of the auxiliary gas burner, quite different arrangements for accomplishing such supply may be used instead. However, the arrangement shown, in which the auxiliary burner is actually a special auxiliary port on the main burner body, is especially advantageous for many purposes.

Thus while the invention has been described in detail with respect to specific embodiments in the interest of complete definiteness, it will be understood that it can be embodied in a variety of forms diverse from those specifically shown and described, without departing from the spirit and scope of the invention as reflected in the appended claims.

What is claimed is:

1. Apparatus for providing indications of a less than adequate supply of combustion air in the vicinity of a port of a main gas burner the flow of primary air-gas mixture for which is supplied from a source of a primary air-gas mixture and the flow of secondary air for which is supplied from a source of secondary air, said apparatus comprising:

an auxiliary gas burner comprising air and gas mixing means, and auxiliary burner port means;

first means for supplying said mixing means with a flow of primary air-gas mixture from said source of said primary air-gas mixture, said last-named flow being small compared with said flow of primary air-gas mixture to said main gas burner but representative of the magnitude of said last-named flow;

second means for supplying said mixing means with a flow of secondary air from said source of secondary air, which flow varies in the same sense as variations in said flow of secondary air to said main burner;

means for supplying said auxiliary burner port means with air-gas mixture from said mixing means;

said flow of secondary air to said mixing means being sufficient to maintain an auxiliary flame at said auxiliary burner port means when the combustion air at said main gas burner port is at an adequate level for supporting satisfactory combustion thereat, but insufficient to maintain said auxiliary burner flame when the combustion air at said main burner port is at a level below said adequate level but sufficient to maintain a flame at said main burner means;

means for sensing the presence or absence of said auxiliary flame to develop signals for controlling said flow of primary air-gas mixture to said main burner; and wherein said main gas burner comprises a main burner body the interior of which is supplied with said flow of primary air-gas mixture under pressure; said apparatus comprises means defining a path for said flow of secondary air to said main gas burner extending along the exterior of the bottom of said burner body; said air-gas mixing means comprising a mixing chamber located within said main burner body and having first aperture means in the walls thereof for the inflow of said primary air-gas mixture from said main burner body and having second aperture means in the walls thereof for the inflow of said secondary air; said second means for supplying said mixing means with a flow of secondary air comprising air deflector means extending into said flow of secondary air along the exterior of the bottom of said burner body for diverting into said mixing chamber, by way of second aperture means, a flow of said secondary air which varies in the same sense as the rate of flow of said secondary air along said path.

2. In combination in a heating system comprising a heat exchanger, a main gas burner having flame ports positioned below said heat exchanger for supplying heat thereto, said main gas burner comprising a burner body supplied with a primary air-gas mixture under pressure, means defining a passage extending along the bottom and upward along the sides and above the top of said main gas burner for supplying a flow of secondary air to the region adjacent the ports of said main gas burner and for collecting and venting combustion products of said main gas burner, said flow of secondary air being subject to unpredictable reduction to a value which is below a mininum adequate level for producing satisfactory combustion but still sufficient to maintain flame at said main gas burner:

means for sensing the occurrence of said reduction in secondary air flow, comprising:

an auxiliary gas burner comprising an air-gas mixing chamber having first walls positioned within said main main burner body, auxiliary burner port means positioned in said main body above said mixing chamber to receive an air-gas mixture from said mixing chamber, and second walls extending upward from said auxiliary burner port means within said main burner body; said first walls having first aperture means communicating with the interior of said main burner body to supply a primary air-gas mixture to the interior of said mixing chamber and having second aperture means in the bottom thereof communicating with the exterior of the bottom of said main burner body for supplying a secondary air flow from below said main gas burner to the interior of said mixing chamber; said second walls having third aperture means extending therethrough to provide an inflow of said primary air-gas mixture from the interior of said burner body to the region above and adjacent said auxiliary burner port means;

scoop means extending into said passage beneath said main gas burner and communicating with said second aperture means for injecting a fraction of the flow of said secondary air into said mixing chamber;

flame-sensing means extending adjacent the top of said auxiliary burner port means for providing indications of the absence of flame at said auxiliary burner port means;

said fraction of said secondary air flow injected into said mixing chamber being sufficient to maintain said flame at said auxiliary burner port means when said flow of secondary air to said main burner ports is at or above said minimum adequate level but insufficient to maintain said last-named flame when said flow of secondary air to said main burner ports falls below said minimum adequate level.

3. The system of claim 2, wherein said main gas burner comprises two horizontally spaced-apart rows of main burner ports and said auxiliary burner port means is located between said rows and sufficiently close thereto to be ignited by flame at one of said main burner ports when conditions at said auxiliary burner port means are such as to support a flame thereon.

4. The system of claim 3, wherein said first and third aperture means each comprise a row of holes on each of two opposite sides of said auxiliary gas burner means, and said second aperture means provides a flow cross-section large compared with the total flow cross-section of said first aperture means.

* * * * *

UNITED STATES PATENT AND TRADEMARK OFFICE

CERTIFICATE OF CORRECTION

PATENT NO. : 4,221,557

DATED : September 9, 1980

INVENTOR(S) : Stephen M. Jalics

It is certified that error appears in the above-identified patent and that said Letters Patent are hereby corrected as shown below:

Column 2, line 17, delete the second occurrence of "spray"
Column 2, line 63, "peferably" should be --preferably--
Column 3, line 35, "FIG" should be --FIGS.--
Column 4, line 24, "necessary" should be --unnecessary--
Column 4, line 65, insert --and-- after "76"
Column 5, line 33, insert --so-- after "level"
Column 6, line 8, "for" should be --of--
Column 7, line 5, insert --operating-- after "manually"
Column 7, line 32, insert --automatically --after "is"
Column 8, line 12, second occurrence of "of" should be --to--
Column 8, line 19, "Th" should be --TH--
Column 8, line 48, "the" should be --this--
Column 11, line 58, "9178" should be --9 1/2--
Column 11, line 68, "linch" should be --1 inch--
Column 13, line 26, delete the second occurrence of "main"

Signed and Sealed this

*Third* Day of *February 1981*

[SEAL]

*Attest:*

RENE D. TEGTMEYER

*Attesting Officer*

*Acting Commissioner of Patents and Trademarks*